US006733151B2

(12) United States Patent
Shu

(10) Patent No.: US 6,733,151 B2
(45) Date of Patent: May 11, 2004

(54) BULB ASSEMBLY WITH MULTIPLE SHELLS

(76) Inventor: Kuo-Fen Shu, 2F-1, No. 152, Nan Yat Street, Hsinchu (TW)

( * ) Notice: Subject to any disclaimer, the term of this patent is extended or adjusted under 35 U.S.C. 154(b) by 0 days.

(21) Appl. No.: 10/227,826

(22) Filed: Aug. 27, 2002

(65) Prior Publication Data

US 2004/0042202 A1 Mar. 4, 2004

(51) Int. Cl.[7] ..... F21S 6/00
(52) U.S. Cl. ..... 362/122; 362/123; 362/806
(58) Field of Search ..... 362/122, 123, 362/806, 249, 252; 428/7, 19; D11/13, 121, 125, 117; D26/101, 102, 25

(56) References Cited

U.S. PATENT DOCUMENTS 3,050,619 A * 8/1962 Abramson ..... 362/122
3,619,598 A * 11/1971 Hermanson ..... 362/122

* cited by examiner

*Primary Examiner*—Sandra O'Shea
*Assistant Examiner*—Sharon Payne
(74) *Attorney, Agent, or Firm*—Rosenberg, Klein & Lee

(57) ABSTRACT

The present invention relates to a bulb assembly with multiple shells, which includes a bulb and a holder and a patterned shell. The patterned shell can be formed by two or more shell units to obtain a beautiful outlook and it can be manufactured easily and economically. A various assembled patterned shell can be made sufficiently.

1 Claim, 2 Drawing Sheets

BULB ASSEMBLY WITH MULTIPLE SHELLS

BACKGROUND OF THE INVENTION

A light string always includes an electrical wire connecting with several bulb assemblies. Each bulb assembly includes a holder, and a bulb, which has a-monotonous outlook. It is known that a patterned shell, such as a flower shape, a star-like shape, and so on, is provided on the bulb assembly to increase the decorative purpose. But the manufacturing procedure of such patterned shell is very difficult and expensive. It is not utilized.

Accordingly, the primary object of the invention is to provide a bulb assembly with multiple shells including two or more simple units for being assembled to form a beautiful outlook. Now the features and advantages of the present invention will be described in detail with reference to the accompanying drawings.

BRIEF DESCRIPTION OF ACCOMPANYING DRAWINGS

DETAILED DESCRIPTION OF PREFERRED EMBODIMENTS

Figure 1:
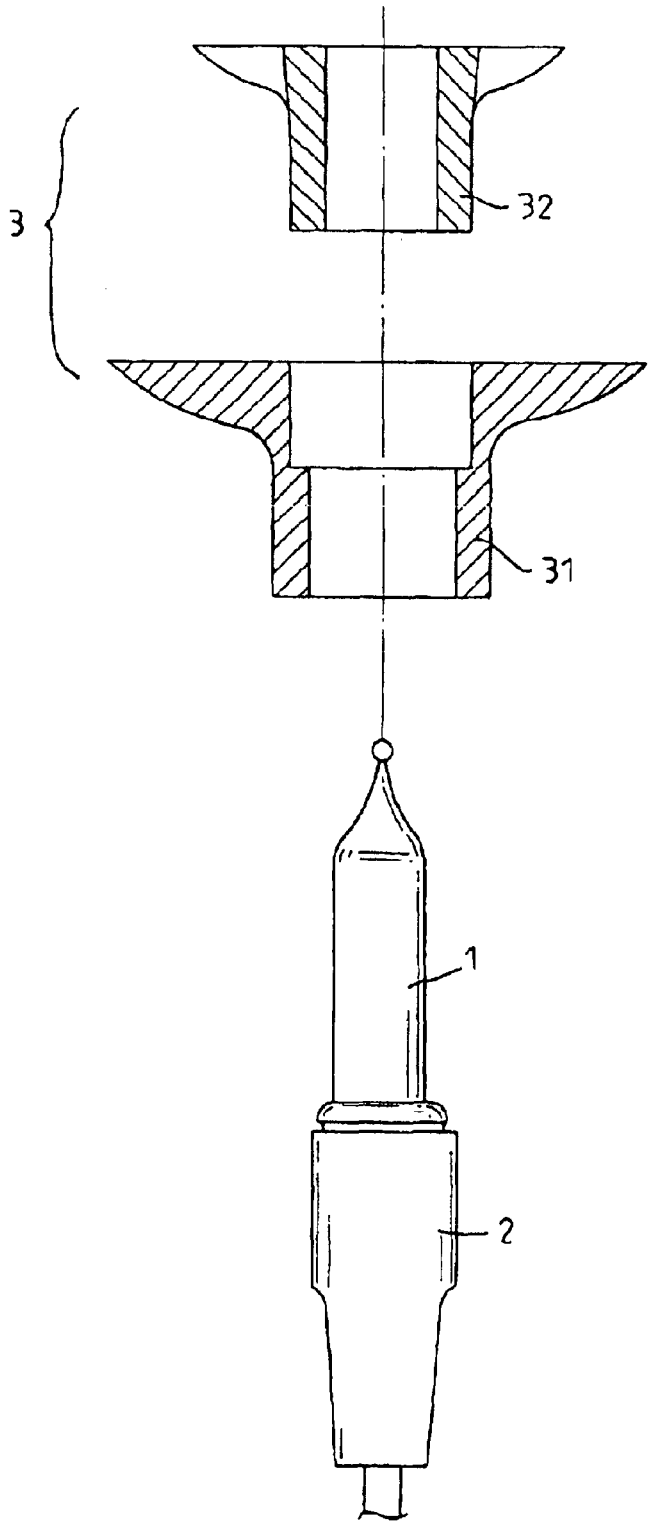
FIG. 1 is an exploded cross-sectional plan view showing a bulb assembly with two shell units according to the present invention.
Figure 3:
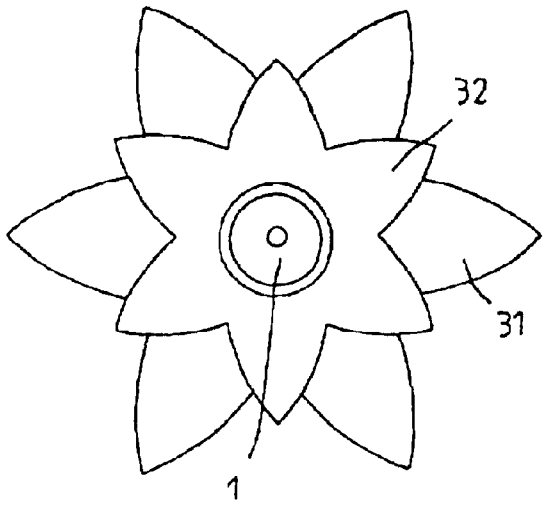
FIG. 3 is a top plan view of FIG. 2.
Figure 2:
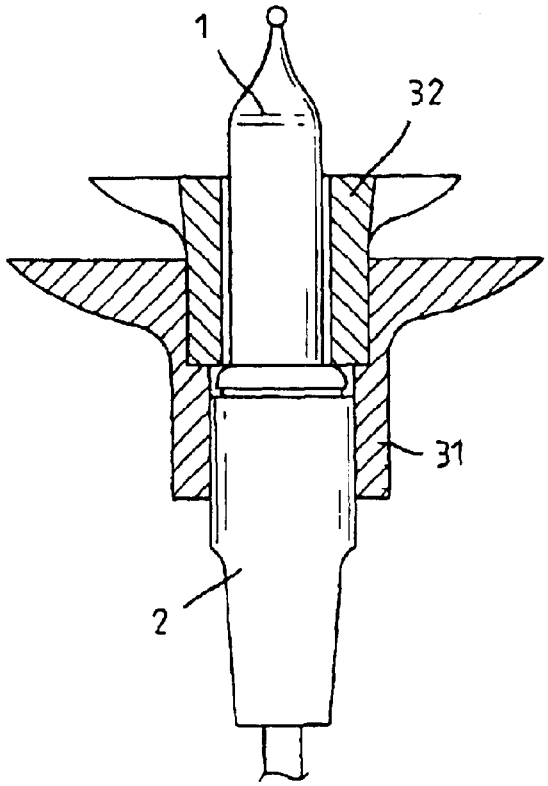
FIG. 2 is an assembled plan view of FIG. 1.

Please refer to FIGS. 1 to 3, the present invention relates to a bulb assembly with assembled multiple shell units. The bulb assembly includes a bulb (1) received in a holder (2).

The characteristic of the present invention is to provide an assembled shell (3) outside the bulb (1) and the holder (2). The assembled shell (3), in this embodiment, has a first unit (31) and a second unit (32), wherein the lower end of the second unit (32) is tightly engaged with the first unit (31) and the holder (2) can be engaged with the lower inner hole of the first unit (31). As the bulb (1) upward extends through the second unit (32), the two assembled units (31) and (32) become a flower shape shell (3) having a very beautiful outlook.

Since each unit has a simple structure, it can be manufactured in ease and economic. The unit can be assembled easily and firmly too. Moreover, the present invention can be completed with more than two units for forming a better decorative effect.

Accordingly, the present invention obviously achieves utility and improvement and should be allowed for patent.

What is claimed is:

1. A decorative bulb assembly comprising (a) a bulb holder, (b) a bulb disposed within said bulb holder, and (c) a plurality of shells coupled to an exterior surface of said bulb holder and having a combined contour in a shape of a flower, said plurality of shells including a first shell unit having a lower axially directed opening into which said bulb holder is received and engaged, said first shell unit having an upper axially directed opening coaxially aligned with said lower opening and in open communication therewith, said plurality of shells including a second shell unit having an axially directed bore formed therethrough, said second shell unit having a lower end engaged within said upper opening of said first shell unit and said bulb being at least partially disposed in said bore of said second shell unit.

* * * * *